US009242360B2

(12) United States Patent
Gresham et al.

(10) Patent No.: US 9,242,360 B2
(45) Date of Patent: Jan. 26, 2016

(54) MULTIPLE PURPOSE HAND TOOL

(71) Applicant: Apex Brands, Inc., Sparks, MD (US)

(72) Inventors: Ian Lyle Gresham, Baltimore, MD (US); Eric Dean Broadaway, New Freedom, PA (US); Christopher Lance, Towson, MD (US)

(73) Assignee: Apex Brands, Inc., Sparks, MD (US)

( * ) Notice: Subject to any disclaimer, the term of this patent is extended or adjusted under 35 U.S.C. 154(b) by 231 days.

(21) Appl. No.: 13/865,674

(22) Filed: Apr. 18, 2013

(65) Prior Publication Data

US 2013/0276240 A1 Oct. 24, 2013

Related U.S. Application Data

(60) Provisional application No. 61/635,026, filed on Apr. 18, 2012, provisional application No. 61/779,295, filed on Mar. 13, 2013.

(51) Int. Cl.

| | |
|---|---|
| ***B25F 1/00*** | (2006.01) |
| ***B25F 1/02*** | (2006.01) |
| ***B25G 1/08*** | (2006.01) |

(52) U.S. Cl.

CPC . *B25F 1/006* (2013.01); *B25F 1/02* (2013.01); *B25G 1/085* (2013.01)

(58) Field of Classification Search

CPC ..... B25F 1/02; B25F 1/006; B26B 11/00
USPC ..... 7/144, 145, 138, 142; 81/177.4, 177.5
See application file for complete search history.

(56) References Cited

U.S. PATENT DOCUMENTS

| | | | | |
|---|---|---|---|---|
| 193,967 | A | | 8/1877 | Knight |
| 825,560 | A | | 7/1906 | Smith |
| 1,411,567 | A | | 4/1922 | Fisher |
| 2,227,455 | A | | 1/1941 | Lane |
| 2,542,603 | A | | 2/1951 | Watters et al. |
| 2,559,689 | A | * | 7/1951 | Truesdell ..... 30/151 |
| 2,559,993 | A | * | 7/1951 | Parrigin et al. ..... 30/161 |
| 2,983,297 | A | | 5/1961 | Wilson |
| 4,373,565 | A | | 2/1983 | Soto |
| D269,496 | S | | 6/1983 | Brown, Jr. |
| 4,435,868 | A | * | 3/1984 | McQueen ..... 7/158 |
| 4,727,609 | A | * | 3/1988 | Smith, Jr. ..... 7/145 |
| 4,741,059 | A | | 5/1988 | Lee et al. |
| 5,159,858 | A | | 11/1992 | Gansen |
| D331,690 | S | | 12/1992 | Villarreal |
| 5,315,725 | A | * | 5/1994 | Vanden Heuvel ..... 7/145 |
| 5,375,486 | A | | 12/1994 | Carmien |
| 5,701,675 | A | * | 12/1997 | Hall et al. ..... 30/123 |
| 5,845,354 | A | | 12/1998 | Long et al. |
| 5,903,942 | A | * | 5/1999 | Hasegawa ..... 7/144 |
| 5,960,677 | A | | 10/1999 | Carmien |
| 5,970,551 | A | | 10/1999 | Allen |
| 5,970,552 | A | | 10/1999 | Kwiecien et al. |
| 5,970,553 | A | * | 10/1999 | Lin ..... 7/143 |
| 6,079,071 | A | * | 6/2000 | Sablan et al. ..... 7/144 |
| 6,122,788 | A | | 9/2000 | Bulcock |

(Continued)

*Primary Examiner* — David B Thomas
(74) *Attorney, Agent, or Firm* — Nelson Mullins Riley & Scarborough, LLP

(57) ABSTRACT

A hand tool comprising a body with a first end and a second end, a striking portion disposed at the first end of the body, a hand grip disposed about a portion of the body, the hand grip defining a first elongated recess, and a cutting device removable received in the first elongated recess of the hand grip.

19 Claims, 7 Drawing Sheets

(56) References Cited

U.S. PATENT DOCUMENTS

| | | | | |
|---|---|---|---|---|
| 6,363,561 | B1 * | 4/2002 | Chang | 7/142 |
| 6,564,681 | B2 | 5/2003 | Coulter | |
| 6,574,816 | B2 * | 6/2003 | Yu Chen | 7/100 |
| 6,592,236 | B1 * | 7/2003 | Lin | 362/119 |
| 6,598,858 | B2 | 7/2003 | Santa Cruz et al. | |
| 6,655,236 | B1 | 12/2003 | Slack et al. | |
| 6,874,186 | B2 * | 4/2005 | Lin | 7/144 |
| 6,922,864 | B2 | 8/2005 | Clarke et al. | |
| 6,923,432 | B1 | 8/2005 | Martinez | |
| 6,959,465 | B1 | 11/2005 | Foster | |
| 6,978,503 | B2 | 12/2005 | Del Cogliano | |
| 7,013,516 | B1 | 3/2006 | Peters | |
| 7,051,391 | B2 * | 5/2006 | Wang | 7/158 |
| 7,080,576 | B2 | 7/2006 | Johnson et al. | |
| 7,121,173 | B2 | 10/2006 | Chen | |
| 7,243,388 | B2 | 7/2007 | Lin | |
| 7,409,894 | B1 | 8/2008 | Valentine | |
| 7,467,572 | B2 | 12/2008 | Fisher et al. | |
| 7,533,430 | B2 | 5/2009 | Moxey | |
| 7,617,749 | B2 | 11/2009 | Kelland | |
| D620,337 | S | 7/2010 | Nuttall et al. | |
| 7,818,843 | B2 | 10/2010 | Kinskey et al. | |
| 8,601,916 | B2 * | 12/2013 | Chen | 81/439 |
| 2001/0037527 | A1 | 11/2001 | Foster | |
| 2002/0178875 | A1 * | 12/2002 | Lin | 81/437 |
| 2004/0065178 | A1 | 4/2004 | Anderson et al. | |
| 2004/0093745 | A1 * | 5/2004 | Liao | 30/519 |
| 2005/0102845 | A1 * | 5/2005 | Dallas et al. | 30/308.1 |
| 2005/0229322 | A1 | 10/2005 | Chiu et al. | |
| 2006/0048305 | A1 | 3/2006 | Giordano et al. | |
| 2006/0253996 | A1 * | 11/2006 | Bianco | 7/160 |
| 2008/0178708 | A1 | 7/2008 | Wheat et al. | |
| 2010/0154598 | A1 | 6/2010 | Sergyeyenko et al. | |
| 2010/0263133 | A1 | 10/2010 | Langan | |
| 2010/0313717 | A1 | 12/2010 | Chen | |
| 2011/0113566 | A1 | 5/2011 | Holbrook | |
| 2011/0138540 | A1 | 6/2011 | Kinskey et al. | |
| 2012/0240341 | A1 * | 9/2012 | Chiang | 7/138 |

* cited by examiner

MULTIPLE PURPOSE HAND TOOL

CLAIM OF PRIORITY

This application claims priority to U.S. Provisional Patent Application Nos. 61/635,026 filed Apr. 18, 2012, and 61/779,295 filed Mar. 13, 2013, the entire disclosures which are incorporated herein.

FIELD OF THE INVENTION

The present invention relates generally to hand tools. More particularly, the present invention relates to a hand tool assembly including multiple tools to facilitate performing multiple tasks.

BACKGROUND OF THE INVENTION

Quite often, articles of furniture require partial, and possibly full, assembly once purchased. This is particularly the case with those items of furniture, i.e., baby cribs, home entertainment cabinets, bookshelves, etc., that are often purchased in superstores such as Walmart, K-Mart, Costco, etc., rather than more traditional furniture stores, as well as those furniture items that can be ordered online for at-home delivery. In addition to furniture, items such as toys, play sets, bicycles, lawn and garden equipment, etc., often require some assembly, not to mention repairs at times. Assembly of such items is frequently offered by the retailer, but at additional cost. Of course, to avoid these additional fees, the purchaser can assemble the item himself. However, assembly often requires multiple types of tools, and the purchase of the multiple sets can prove costly.

The present invention recognizes and addresses considerations of prior art constructions and methods.

SUMMARY OF THE INVENTION

One embodiment of the present invention provides a hand tool comprising a body with a first end and a second end, a striking portion disposed at the first end of the body, a hand grip disposed about the body, the hand grip defining a first elongated recess, and a cutting device removably received in the first elongated recess of the hand grip.

Another embodiment of the present invention provides a hand tool comprising a body with a first end and a second end, a ratcheting drive assembly disposed at the second end of the body, a hand grip disposed about the body, the hand grip defining a recess including a magnet, the hand grip being constructed of a resilient material, and a cutting device. The cutting device is removably received in the recess of the hand grip and retained therein by the magnet.

Another embodiment of the present invention provides a hand tool comprising a body having an elongated handle portion with a first end and a second end, a ratcheting drive assembly disposed at the second end of the elongated handle, a hand grip disposed about the elongated body, the hand grip defining a recess and being constructed of a resilient material, and a cutting device. The cutting device is removably received in the recess of the hand grip in an interference fit.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
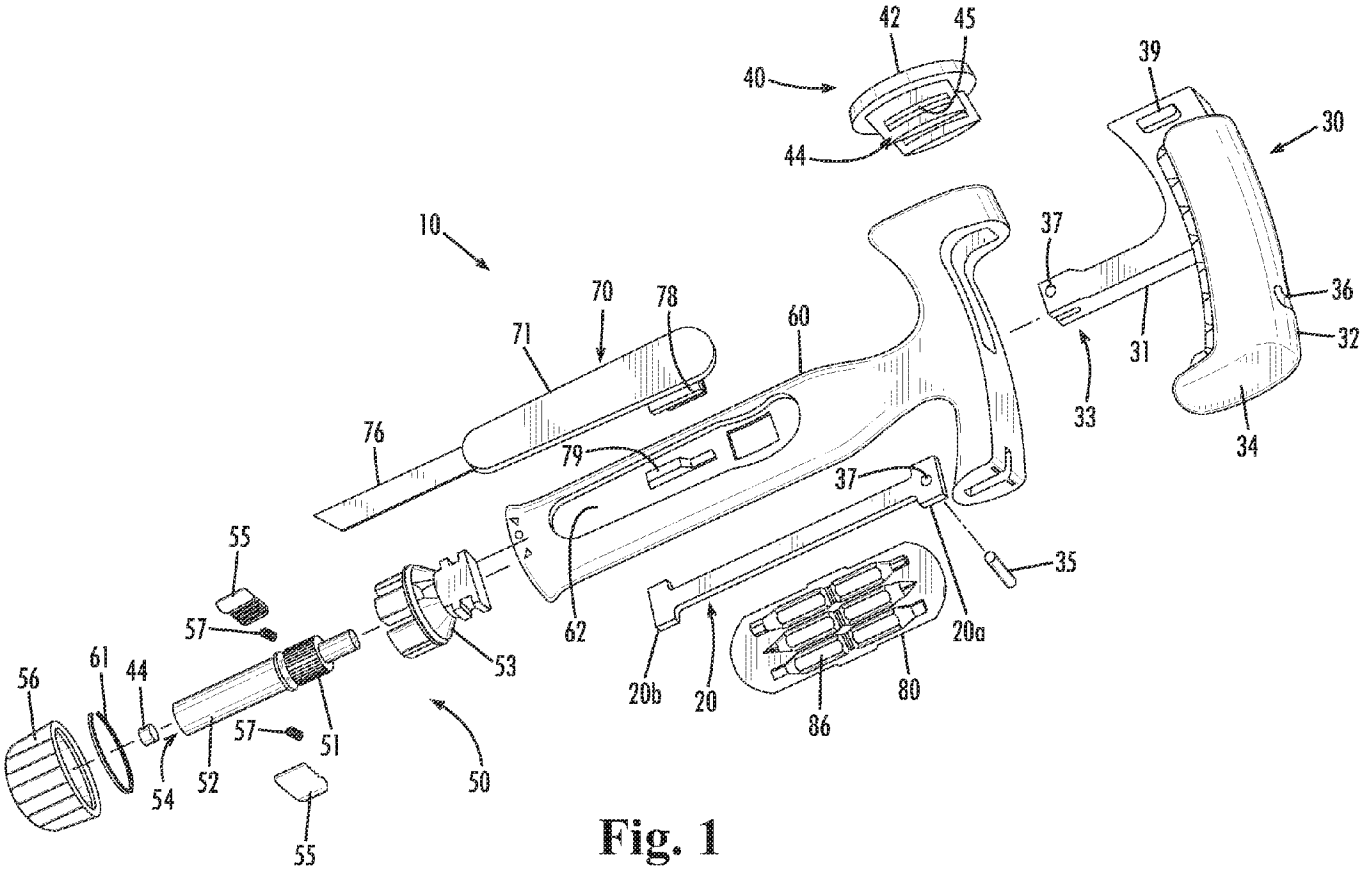
FIG. 1 is an exploded perspective view of a multiple purpose hand tool in accordance with an embodiment of the present disclosure.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring to FIGS. 1 through 6, a multiple purpose hand tool 10 in accordance with the present disclosure includes an elongated body 20, a striking portion 30, a ratcheting drive assembly 50, a hand grip 60, a box cutter 70 and a tool bit holder 80. As best seen in FIG. 1, striking portion 30 is disposed at a first end 20*a* of handle portion 22 and is substantially transverse thereto. Striking portion 30 includes a stem 31 depending therefrom that includes a yoke 33 at its distal end. First end 20*a* of body 20 is received by yoke 33 and a pin 35 is received in corresponding bores 37 defined by yoke 33 and the first end of body 20 to secure striking portion 30 to the body.

Figure 6:
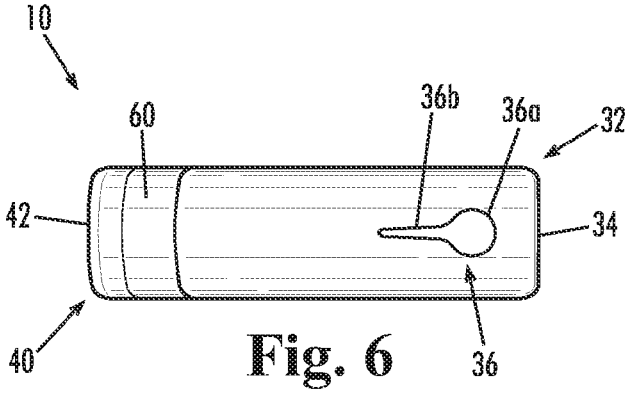
FIG. 6 is a top view of the multiple purpose hand tool shown in FIG. 1.
Figure 7A:
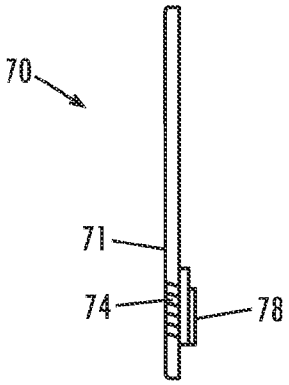
FIGS. 7A, 7B, 7C and 7D are right side, top, bottom, and left side views of a box cutter of the multiple purpose hand tool shown in FIG. 1.
Figure 7B:
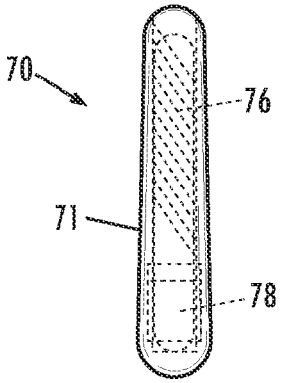
Figure 7C:
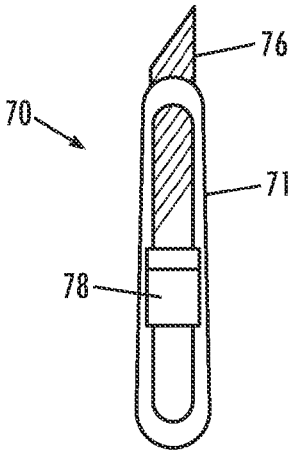
Figure 7D:
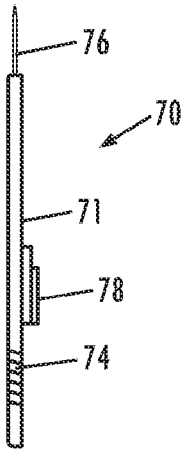

Striking portion 30 includes a hammer head 32 with a substantially planer striking surface 34. Preferably, hammer head 32 is constructed of steel. As such, striking surface 34 of hammer head 32 is particularly suited for driving nails, tacks, or similar type fasteners. A nail puller 36 is defined in the top surface of striking portion 30 and facilitates the removal of various shaped fasteners. As best seen in FIG. 6, nail puller 36 includes a substantially circular recess 36*a* for receiving the head of a fastener (not shown) and an elongated recess 36*b* depending outwardly therefrom that is adapted to slidably receive the shank of the fastener beneath its head. Note, although striking portion 30 is preferably formed separately from body 20, in alternate embodiments, body 20 and striking portion 30 can be formed unitarily. As well, if formed separately, they may be constructed of the same, or different, materials and joined by methods such as welding, male/female threaded joints, etc.

In addition to hammer head 32, striking portion 30 also includes a mallet head 40. Mallet head 40 is disposed opposite hammer head 32 on striking portion 30 and includes a striking surface 42 that is substantially parallel to striking surface 34 of hammer head 32. Preferably, mallet head 40 includes a yoke 44 in which each leg defines a recess 45. Recesses 45 of mallet head 40 are configured to receive a pair of projections 39 depending outwardly from opposing surfaces of striking portion 30, thereby securing the two elements to each other. In alternate embodiments, mallet head 40 may be co-molded to hand grip 60.

Mallet head 40 is constructed of a rubber-like material and, as such, mallet head 40 is particularly suited for striking objects which could be damaged if struck with metal hammer head 32. For example, mallet head 40 can be used for striking objects constructed of wood, plastic, rubber, etc., or objects with coatings such as paint, varnish, etc., that are easily marred. Mallet head 40 can be constructed of alternate materials such as plastic, nylon, polycarbonate, polystyrene, etc., dependent upon the intended use of mallet head 40 and the material of which the item being struck is constructed. Mallet head 40 is preferably constructed from materials that are non-marking with regard to the item being struck. In additional alternate embodiments, mallet head 40 can be removably secured to hammer head 32 by means other than the preferred projections and recesses. For example, a threaded projection (not shown) of hammer head 32 can be received in a correspondingly threaded recess (not shown) of mallet head 40, or vice versa. As such, various mallet heads 40 constructed of various materials can be selectively connected to striking portion 30 of multiple purpose tool 10.

Figure 2:
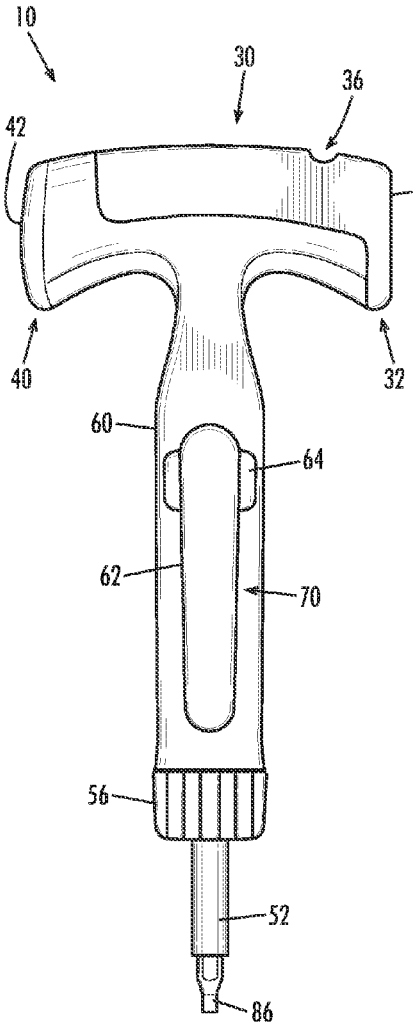
FIG. 2 is a front view of the multiple purpose hand tool shown in FIG. 1.

Ratcheting drive assembly 50 is disposed on a second end 20*b* handle portion 22 opposite striking portion 30 and includes an elongated drive member 52 extending outwardly therefrom and a control ring 56. Elongated drive member 52 includes a socket 54 formed on its distal end that is configured to selectively receive a tool bit 86. An annular array of ratchet teeth 51 is disposed about the proximal end of drive member 52, the proximal end being received in a housing 53 of the ratchet assembly. Further, a pair of drive pawls 55 and corresponding springs 57 are pivotably received in the housing and are configured to selectively engage the ratchet teeth 51. Rotation of control ring 56 relative to hand grip 60 allows a user to determine whether torque is applied with ratcheting drive assembly 50 in either the clockwise (CW) or counterclockwise (CCW) direction. Control ring 56 includes ribbing to facilitate rotation by the user. Control ring 56 is pivotably secured to housing 53 by a c-clip 61 that is received in corresponding annular grooves on both elements. As best seen in FIGS. 1 and 2, striking portion 30 can be utilized as a T-shaped handle when driving fasteners with multiple purpose tool 10.

Figures 4, 5:
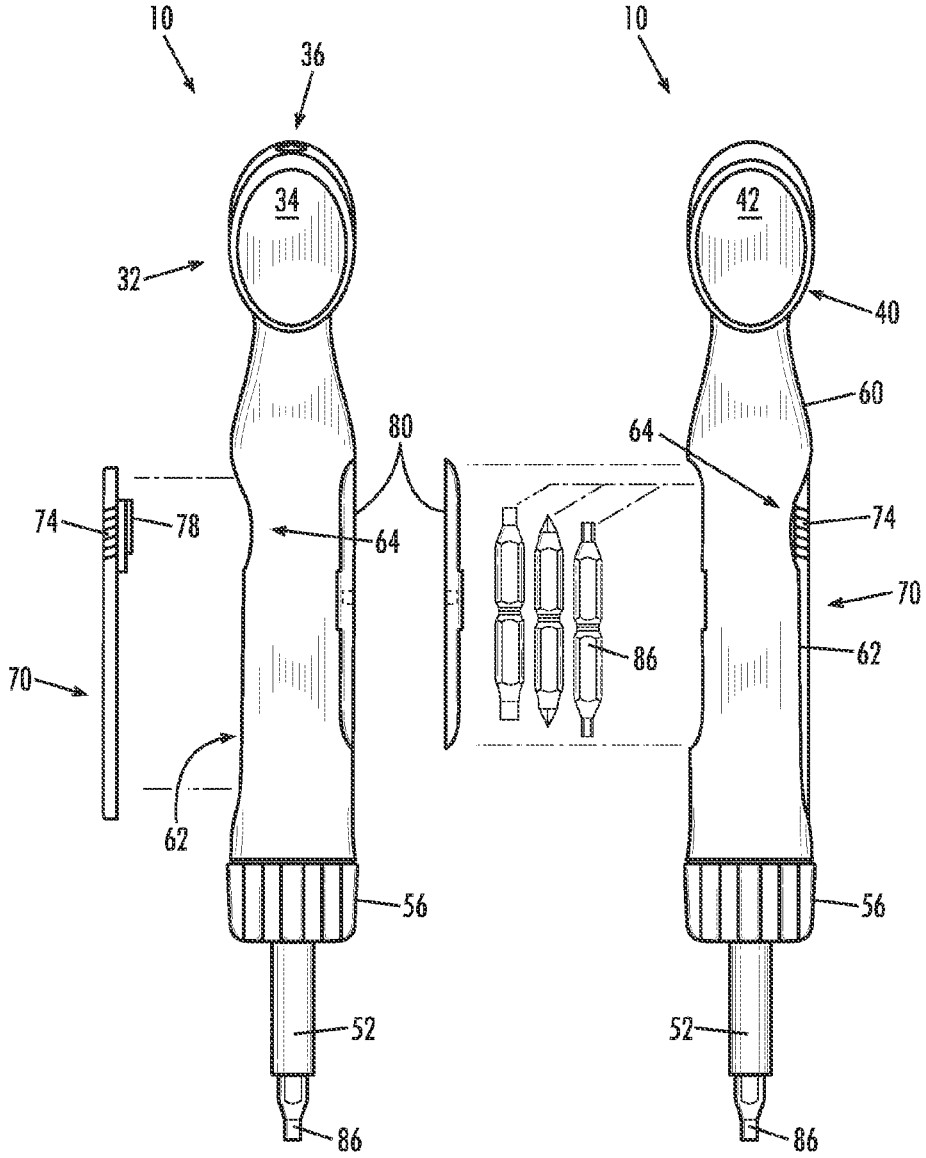
FIG. 4 is a right side view of the multiple purpose hand tool shown in FIG. 1.
FIG. 5 is a left side view of the multiple purpose hand tool shown in FIG. 1.

Hand grip 60 is disposed about handle portion 22 of body 20 as well as portions of striking portion 30. Preferably, hand grip 60 is molded of a resilient polymer, such as, but not limited to, thermoplastic elastomer (TPE), thermoplastic rubber (TPR) or other suitable materials that exhibit the desired durability and tactile feel for the user. As best seen in FIGS. 1 and 4, hand grip 60 defines a first elongated recess 62 that is configured to removably receive box cutter 70. Box cutter 70 includes a housing 71, a cutting blade 76, a button 78 and a pair of finger grips 74. Button 78 is fixed to the base of blade 76 and allows a user to extend and retract the blade relative to housing 71 during use. As best seen in FIG. 5, when box cutter 70 is received in first elongated recess 62 of hand grip 60, button 78 is disposed inside hand grip 60, thereby preventing the user from inadvertently extending blade 76 from the housing. A magnet 79 is disposed in the base of first elongated recess 62. Magnet 79 is configured to engage a portion of blade 76 when box cutter 70 is stored in the recess, thereby releasably securing the box cutter in the handle. Additionally, hand grip 60 defines a pair of grooves 64 disposed on opposing sides of first elongated recess 62. Grooves 64 are positioned to correspond to finger grips 74 of box cutter 70. As such, finger grips 74 are accessible by the user when box cutter 70 is stored in first elongated recess 62, thereby facilitating removal of box cutter 70 from first elongated recess 62 by the user. For example, finger grips 74 of box cutter 70 are readily accessible by the thumb and forefinger of the user.

Figure 3:
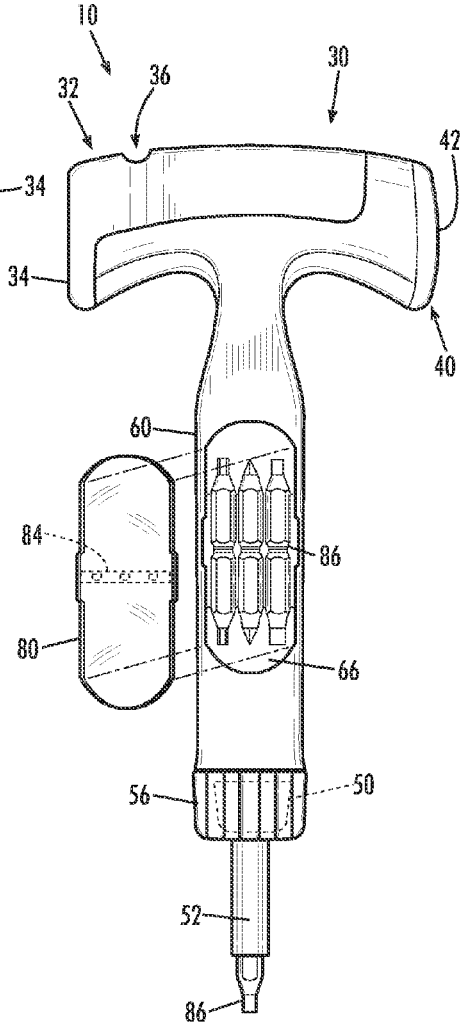
FIG. 3 is a rear view of the multiple purpose hand tool shown in FIG. 1.

Tool bit holder 80 is preferably formed of a resilient polymer and defines mounting slots 84 that are configured to releasably secure a plurality of tool bits therein. As best seen in FIGS. 3 and 5, tool bit holder 80 is slidably received in a second elongated recess 66 defined by hand grip 60 and is selectively removable therefrom. Preferably, mounting slots 84 are configured to removably receive various tool bits 86 in an interference fit. As such, multiple tool bits 86, such as, but not limited to, Phillips screwdriver heads, standard screwdriver heads, hex drives, sockets, etc., are readily accessible to the user.

Figure 8:
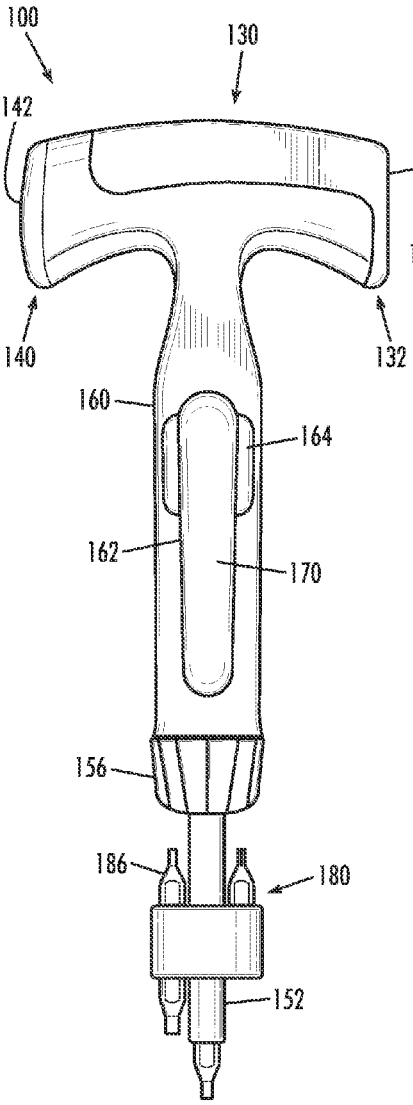
FIG. 8 is a front view of a multiple purpose hand tool in accordance with an alternate embodiment of the present disclosure.
Figure 9:
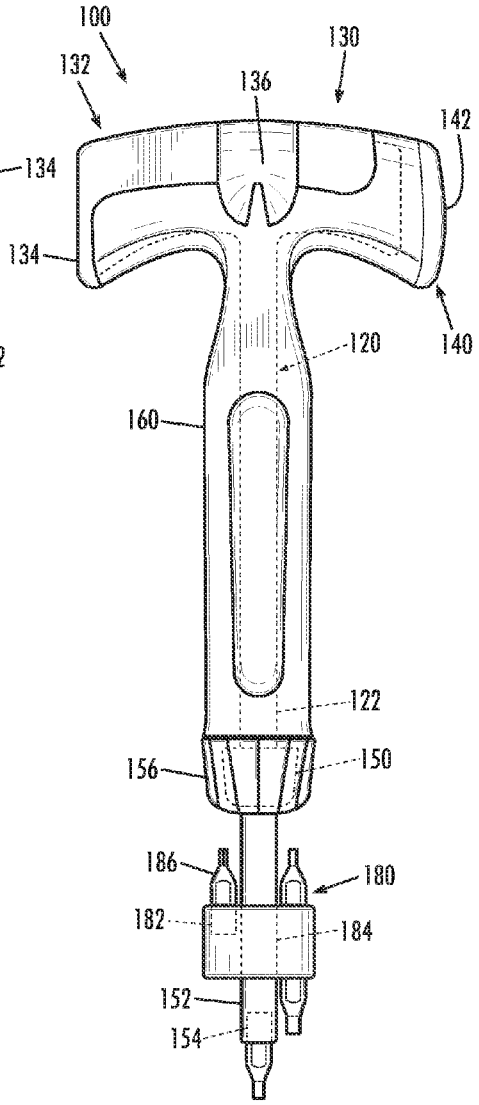
FIG. 9 is a rear view of the multiple purpose hand tool shown in FIG. 8.

Referring to FIGS. 8 through 13, an alternate embodiment of a multiple purpose hand tool 100 in accordance with the present disclosure includes a body 120 with an elongated handle portion 122, a striking portion 130, a ratcheting drive assembly 150, a hand grip 160, a box cutter 170 and a tool bit holder 180. As best seen in FIG. 9, striking portion 130 is disposed at a first end of handle portion 122 and is substantially transverse thereto. Striking portion 130 includes a hammer head 132 with a substantially planer striking surface 134. Hammer head 132 is constructed of steel and is, preferably, unitarily formed with handle portion 122 of body 120. As such, striking surface 134 of hammer head 132 is particularly suited for driving nails, tacks, or similar type fasteners. A nail puller 136 depends outwardly and downwardly from the side of hammer head 132 to facilitate in the removal of various shaped fasteners. Note, although hammer head 132 is preferably unitarily formed with body 120, in alternate embodiments, body 120 and hammer head 132 can be formed separately of the same, or different, materials and joined by methods such as welding, male/female threaded joints, etc.

In addition to hammer head 132, striking portion 130 also includes a mallet head 140. Mallet head 140 is disposed opposite hammer head 132 on striking portion 130 and includes a striking surface 142 that is substantially parallel to striking surface 134 of hammer head 132. Preferably, mallet head 140 is co-molded to hand grip 160 and is constructed of a rubber-like material. As such, mallet head 140 is particularly suited for striking objects which could be damaged if struck with metal hammer head 132. For example, mallet head 140 can be used for striking objects constructed of wood, plastic, rubber, etc. or objects with coatings such as paint, varnish, etc., that are easily marred. Mallet head 140 can be constructed of alternate materials such as plastic, nylon, polycarbonate, polystyrene, etc., dependent upon the intended use of mallet head 140 and the material of which the item being struck is constructed. Mallet head 140 is preferably constructed from materials that are non-marking with regard to the item being struck. Although mallet head 140 is preferably co-molded with hand grip 160, in alternate embodiments, mallet head 140 can be removably secured to hammer head 132. For example, a threaded projection (not shown) of hammer head 132 can be received in a correspondingly threaded recess (not shown) of mallet head 140, or vice versa. As such, various mallet heads 140 constructed of various materials can be selectively connected to striking portion 130 of multiple purpose tool 100

Ratcheting drive assembly 150 is disposed on handle portion 122 opposite striking portion 130 and includes an elongated drive member 152 extending outwardly therefrom and a control ring 156. Elongated drive member 152 includes a socket 154 (FIG. 9) formed on its distal end that is configured to selectively receive a tool bit 186. Rotation of control ring 156 relative to hand grip 160 allows a user to determine whether torque is applied with ratcheting drive assembly 150 in either the clockwise (CW) or counter-clockwise (CCW) direction. Control ring 156 includes ribbing to facilitate rotation by the user. As best seen in FIGS. 8 and 9, striking portion 130 can be utilized as a T-shaped handle when driving fasteners with multiple purpose tool 100.

Figure 10:
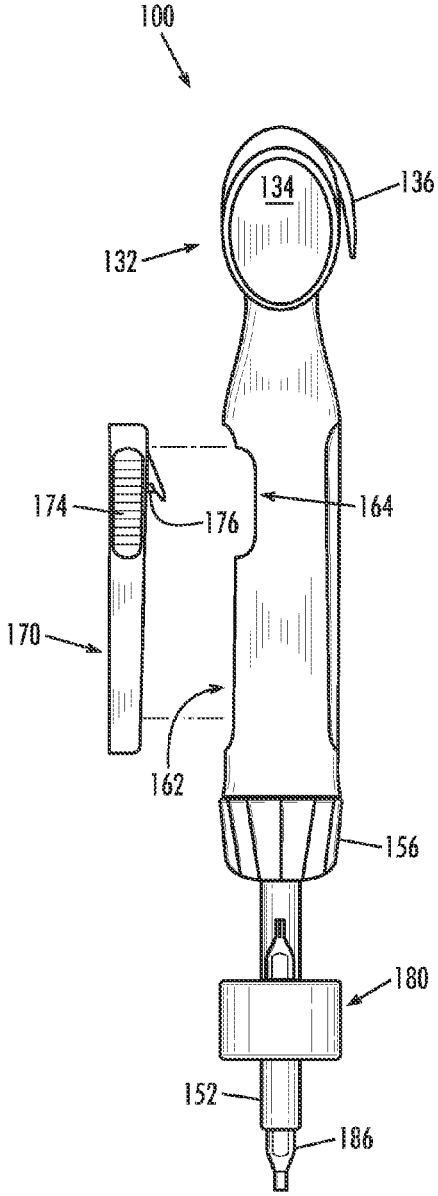
FIG. 10 is a right side view of the multiple purpose hand tool shown in FIG. 8.
Figure 11:
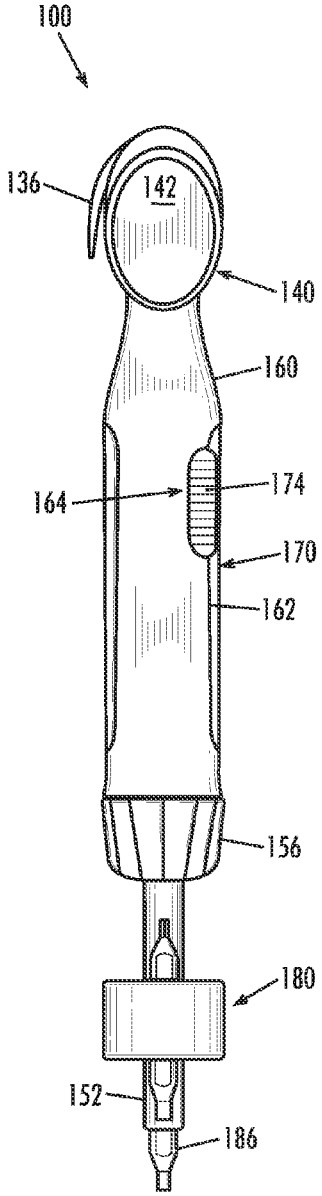
FIG. 11 is a left side view of the multiple purpose hand tool shown in FIG. 8.
Figure 12:
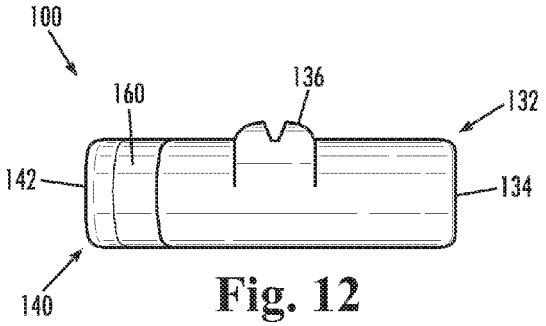
FIG. 12 is a top view of the multiple purpose hand tool shown in FIG. 8.
Figure 13A:
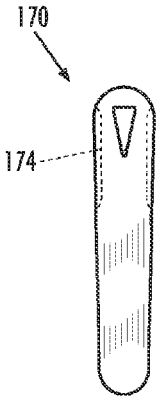
FIGS. 13A, 13B and 13C are bottom, left side and right side views of a box cutter of the multiple purpose hand tool shown in FIG. 8.
Figure 13B:
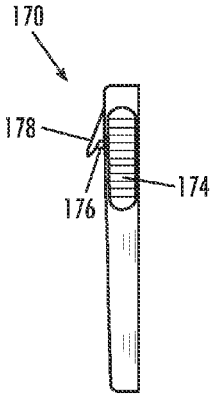
Figure 13C:
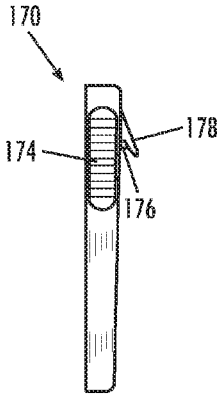

Hand grip 160 is disposed about handle portion 122 of body 120 as well as portions of striking portion 130. Preferably, hand grip 160 is molded of a resilient polymer, such as, but not limited to, thermoplastic elastomer (TPE), thermoplastic rubber (TPR) or other suitable materials that exhibit the desired durability and tactile feel for the user. As best seen in FIGS. 10 and 11, hand grip 160 defines an elongated recess 162 that is configured to removably receive box cutter 170. Box cutter 170 includes a cutting blade 176, a projection 178 and a pair of finger grips 174. Projection 178 serves to protect the user from inadvertent contact with blade 176. As best seen in FIG. 11, when box cutter 170 is received in elongated recess 162 of hand grip 160, both blade 176 and projection 178 are disposed inside hand grip 160, thereby protecting the user. Additionally, hand grip 160 defines a pair of grooves 164 disposed on opposing sides of elongated recess 162. Grooves 164 are positioned to correspond to finger grips 174 of box cutter 170. As such, finger grips 174 are accessible by the user when box cutter 170 is stored in elongated recess 162, thereby facilitating removal of box cutter 170 from elongated recess 162 by the user. For example, finger grips 174 of box cutter 170 are readily accessible by the thumb and forefinger of the user.

Tool bit holder 180 is preferably formed of a resilient polymer, similar to hand grip 160, and defines a mounting aperture 184 and a plurality of bit recesses 182. Tool bit holder 180 is slidably received on elongated drive member 152 and selectively removable therefrom. As such, tool bit holder 180 can be removed from elongated drive member 152 when ratcheting drive assembly 150 is used to drive fasteners in restricted spaces. Bit recesses 182 (FIG. 9) are configured to removably receive various tool bits 186 in an interference fit. As such, multiple tool bits 186, such as, but not limited to, Phillips screwdriver heads, standard screwdriver heads, hex drives, sockets, etc., are readily accessible to the user.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

What is claimed is:

1. A hand tool comprising:
a body with a first end and a second end;
a hammer head disposed at the first end of the body;
a hand grip disposed about the body, the hand grip defining a first elongated recess; and
a cutting device removably received in the first elongated recess of the hand grip,
wherein the cutting device further comprises a box cutter with a housing and a blade, the blade being selectively slidable relative to the housing.

2. A hand tool comprising:
a body with a first end and a second end;
a striking portion disposed at the first end of the body;
a hand grip disposed about the body, the hand grip defining a first elongated recess;
a cutting device removably received in the first elongated recess of the hand grip; and
a ratcheting drive assembly disposed at the second end of the body.

3. The hand tool of claim 2, further comprising an elongated drive member operatively connected to the ratcheting drive, wherein a distal end of the elongated drive member defines a socket configured to receive the at least one tool bit.

4. A hand tool comprising:
a body with a first end and a second end;
a striking portion disposed at the first end of the body;
a hand grip disposed about the body, the hand grip defining a first elongated recess;
a cutting device removably received in the first elongated recess of the hand grip; and
a hammer head with a striking surface disposed at a first end of the striking portion and a mallet head with a striking surface disposed at a second end of the striking portion, wherein the striking portion is substantially transverse to the body of the hand tool.

5. The hand tool of claim 4, wherein the hammer head is constructed of metal and the mallet head is constructed of a resilient material.

6. The hand tool of claim 4, wherein the mallet head is removably secured to the hammer head.

7. A hand tool comprising:
a body with a first end and a second end;
a striking portion disposed at the first end of the body;
a hand grip disposed about the body, the hand grip defining a first elongated recess;
a cutting device removably received in the first elongated recess of the hand grip; and
a tool bit holder adapted to removably receive at least one tool bit, wherein the tool bit holder is removably received in a second elongated recess defined by the hand grip.

8. A hand tool comprising:
a body with a first end and a second end;
a ratcheting drive assembly disposed at the second end of the body;
a hand grip disposed about the body, the hand grip defining a recess including a magnet, the hand grip being constructed of a resilient material; and a cutting device, wherein the cutting device is removably received in the recess of the hand grip and retained therein by the magnet.

9. The hand tool of claim 8, further comprising a striking portion disposed at a first end of the body, wherein a hammer head with a striking surface is disposed at a first end of the striking portion and a mallet head with a striking surface is disposed at a second end of the striking portion.

10. The hand tool of claim 9, wherein the striking portion further comprises a nail puller formed by a recess in the outer surface of the striking portion.

11. The hand tool of claim 9, wherein the mallet head is removably secured to the hammer head.

12. A hand tool comprising:

a body having an elongated handle portion with a first end and a second end;

a ratcheting drive assembly disposed at the second end of the elongated handle;

a hand grip disposed about the elongated handle portion, the hand grip defining a recess and being constructed of a resilient material; and a cutting device, wherein the cutting device is removably received in the recess of the hand grip in an interference fit.

13. The hand tool of claim 12, wherein the hand grip is constructed of a polymer.

14. The hand tool of claim 12, wherein the cutting device further comprises a box cutter with a blade extending outwardly therefrom, and the blade is disposed within the hand grip when the box cutter is disposed in the recess of the hand grip.

15. The hand tool of claim 12, further comprising a striking portion disposed at a first end of the elongated body, wherein a hammer head with a striking surface is disposed at a first end of the striking portion and a mallet head with a striking surface is disposed at a second end of the striking portion.

16. The hand tool of claim 15, wherein the hammer head further comprises a nail puller formed by a pair of forked prongs, wherein the nail puller extends downwardly from the hammer head and is substantially parallel to a longitudinal center axis of the elongated body member.

17. The hand tool of claim 15, wherein the hammer head is unitarily formed with the elongated handle portion and constructed of metal, and the mallet head is constructed of a resilient material.

18. The hand tool of claim 17, wherein the mallet head is co-molded with the hand grip.

19. The hand tool of claim 12, further comprising a tool bit holder adapted to removably receive at least one tool bit, when the tool bit holder is removably received on a portion of the ratcheting drive assembly.

* * * * *